US005741767A

United States Patent [19]

Nicholson et al.

[11] Patent Number: 5,741,767

[45] Date of Patent: Apr. 21, 1998

[54] PERACID BASED DISHWASHING DETERGENT COMPOSITION

[75] Inventors: John Richard Nicholson, Ramsey; Isaac Israel Secemski, Teaneck; Deborah Sue Rick, New Milford; Duane Anthony Raible, Park Ridge, all of N.J.

[73] Assignee: Lever Brothers Company, Division of Conopco, Inc., New York, N.Y.

[21] Appl. No.: 558,994

[22] Filed: Nov. 16, 1995

[51] Int. Cl.[6] ..... C11D 7/38; C11D 7/42

[52] U.S. Cl. ..... 510/220; 510/221; 510/223; 510/226; 510/227; 510/229; 510/230; 510/372; 510/374; 510/375; 510/392; 510/393; 510/441; 134/25.2

[58] Field of Search ..... 510/220, 221, 510/226, 441, 223, 227, 229, 230, 372, 374, 375, 392, 393; 134/25.2

[56] References Cited

U.S. PATENT DOCUMENTS

| | | | |
|---|---|---|---|
| 4,568,476 | 2/1986 | Kielman et al. | 252/95 |
| 5,173,207 | 12/1992 | Drapier et al. | 252/90 |
| 5,200,236 | 4/1993 | Lang et al. | 427/213 |
| 5,468,410 | 11/1995 | Angevaare et al. | 252/95 |
| 5,480,576 | 1/1996 | Gary et al. | 252/95 |
| 5,534,180 | 7/1996 | Miracle et al. | 510/220 |

FOREIGN PATENT DOCUMENTS

| | | |
|---|---|---|
| 684 304 | 11/1985 | European Pat. Off. . |
| 208 491 | 8/1993 | European Pat. Off. . |
| 1 296 839 | 11/1972 | United Kingdom . |
| 94/02597 | 2/1994 | WIPO . |
| 94/14951 | 7/1994 | WIPO . |

OTHER PUBLICATIONS

Enzyme Material Safety Data Sheet; Commercial Product Name: SP7-3 (T-granulate amylase).

Enzyme Material Saftey Data Sheet, Commercial Product Name: Duramyl 300 L, Type DX.

Genencor Material Safety Date Sheet; Product Name: Purafect® OxAm 4000G.

P. Bernfeld, "Method of Enzymology", vol. 1 (1995), p. 149.

Liisa Holm et al., 1990, Protein Engineering 3, pp. 181-191.

*Primary Examiner*—Douglas J. McGinty
*Assistant Examiner*—Lorna M. Douyon
*Attorney, Agent, or Firm*—A. Kate Huffman

[57] ABSTRACT

A warewashing composition for a machine dishwasher and a method of using it is described. The composition comprises effective amounts of an organic peroxy acid, and an amylase enzyme which, when incubated at 55° C. in a solution of 2 mM sodium citrate, 1 mM epsilon phthalimidoperoxyhexanoic acid in 36 ppm water at pH 8.0, has a half-life of two minutes or greater based on an activity vs. time plot obtained via monitoring color development at 405 nm of solution samples incubated with p-nitrophenyl-α-D-maltoheptaoside as substrate and gluco amylase and α-glucosidase as coupled enzymes; and 1% to 75% by weight of a builder. A 1% aqueous solution of the composition must have a pH of less than 10.

29 Claims, No Drawings

PERACID BASED DISHWASHING DETERGENT COMPOSITION

FIELD OF INVENTION

The invention relates to a low alkalinity dishwashing detergent composition containing a peracid, a bleach resistant amylase and a builder. A method of using the composition is also described.

BACKGROUND OF THE INVENTION

Many conventional dishwashing systems use high alkalinity cleaning compositions which may include chlorine bleach as sanitizer. Whilst these systems are highly effective with regard to the removal of hydrophilic and bleachable stains from dishware, they have an inherent weakness with respect to the removal of starch-containing food soils. Incomplete removal of starch in successive washes leads to a gradual build-up of soil so that after only one to two weeks of cleaning with these systems the appearance of the dishware can become unacceptable. At this point, extensive soaking of the dishware may be required which is a separate operation that is laborious, time-consuming, and very expensive. Such build up problems are especially pronounced in industrial and institutional warewashing where foods and dishware are subject to high temperatures for prolonged periods of time during food preparation, distribution and serving.

Amylase enzymes have been proposed as a solution to the problem of starch build-up on cleaned dishware. However, amylases are less effective at wash pHs greater than 10 (see GB 1 296 839 (Novo)), and are incompatible with chlorine bleach. As a consequence, trends in formulating dishwashing compositions with amylase have been toward the use of peroxygen bleaching agents in lieu of halogen bleach sources. Because oxygen bleaching systems tend to be less effective than chlorine on tannin stains, those cleaning systems that use amylase enzymes and which have been proposed to date, provide only moderate levels of removal of bleachable stains such as tannin. Indeed, no single system that has been proposed to date can effectively meet the requirements of excellent starch and tannin removal.

Bleach resistant amylase enzymes described in the art may be incorporated with either halogen or peroxygen bleaches in a detergent composition as described in WO 94/02597 (Novo); EP 208 491 (Genencor) and WO 94/14951 (Novo). Although such systems should deliver both excellent starch and tannin removal, it has been observed that the mere replacement of standard enzymes with the bleach-resistant varieties in conventional formulations results in poorer, rather than improved, overall performance. A need still exists for stable compositions which deliver effective performance over a full range of soils and stains.

Cleaning systems which deliver both excellent starch and tannin removal have now been discovered. It has been found that selected oxygen bleaches formulated in a non-conventional pH range can meet these demanding performance targets. In addition, surprising synergistic interactions between certain bleaches, bleach resistant enzymes, builders and wash conditions have actually been found to enhance enzyme activity and improve enzyme stability to provide cleaning systems which deliver excellent performance over a full range of soils and stains.

SUMMARY OF THE INVENTION

A warewashing detergent composition for use in both domestic and industrial dishwashing machines is described.

The composition comprises an effective amount of an organic peroxy acid, preferably a monoperoxy acid; an effective amount of an amylase enzyme which, when incubated at 55° C. in a solution of 2 mM sodium citrate, 1 mM epsilon phthalimidoperoxyhexanoic acid in 36 ppm water at pH 8.0, has a half-life of two minutes or greater based on an activity vs. time plot obtained via monitoring color development at 405 nm of solution samples incubated with p-nitrophenyl-α-D-maltoheptaoside as substrate and gluco amylase and α-glucosidose as coupled enzymes; 1–75 wt. % of a selected builder provided that a 1% aqueous solution of the detergent composition has a pH of less than about 10, preferably about 6 to about 9. It is preferred that the level of calcium ions in the wash solution be at least 10 ppm expressed as calcium carbonate.

DETAIL DESCRIPTION OF THE PREFERRED EMBODIMENTS

The compositions of the invention may be in any form conventional in the arts such as powder, tablet, block, liquid or gel. The compositions may also be produced by any conventional means.

Novel combinations of cleaning agents have been identified that will satisfy the demand for excellent starch and tannin removal from a single wash system. This system comprises effective amounts of an organic peroxy acid, an effective amount of an amylase enzyme which, when incubated at 55° C. in a solution of 2 mM sodium citrate, 1 mM epsilon phthalimidoperoxyhexanoic acid in 36 ppm water at pH 8.0, has a half-life of two minutes or greater based on an activity vs. time plot obtained via monitoring samples on a Roche Cobas Fara Analyzer using Roche Reagent, and about 1 to about 75 wt% of a builder, provided that a 1% aqueous solution of the detergent composition has a pH of less than 10.

Peroxy Acids

Since amylase enzymes are ineffective in a wash pH range of greater than about 10, it is necessary to be able to achieve good bleach performance in a wash having a pH value of less than about 10 in order to meet the dual criteria of excellent starch and excellent tannin removal.

It is also desirable to replace a halogen bleach with a peroxygen bleach to provide a milder and more environmentally friendly composition.

Typically, formulations based on oxygen bleaches include sodium perborate, sodium percarbonate or hydrogen peroxide. These oxygen bleaches are preferably used in conjunction with a bleach activator to provide more effective bleaching at temperatures of below about 60° C.

However, in the present invention, selection of the bleach moiety is critical. Despite claims that the bleach-resistant amylases are functional with a full range of bleaches, excellent overall performance is not achieved with this range.

Thus, the bleaching performance of hydrogen peroxide ($H_2O_2$) decreases as the pH of the, wash is reduced from about 12 to about 10. At pH 10, in short wash times, inclusion of $H_2O_2$ provides no extra tannin removal benefits than could be obtained through the utilization of a strong builder such as nitrilotriacetate. Therefore, there is no advantage for a bleach-resistant amylase with hydrogen peroxide. In fact, at pH 10, the combination of $H_2O_2$ conventional amylase is more effective with regard to starch removal than the combination of $H_2O_2$ /bleach-resistant amylase.

Peroxide/activator systems generally require a wash pH of about 10 in order to achieve rapid rates of perhydrolysis.

something that would be essential at short wash times. However, this requirement conflicts with the optimum conditions for starch removal since the activity of the novel bleach-resistant amylase is very low at wash pH's of about 10 and starch removal is poor.

Thus the oxygen bleach that is suitable for the invention must be a selected organic peroxyacid which has its maximum stain removal efficacy at a wash pH of about 8.5, which is generally at, or near, the pKa of the peracid, and wherein a 1% aqueous solution has a pH of less than 10, preferably 6 to about 9.

Note that while peracetic acid (PAA) has a pKa of 8.2, its stain removal performance increases through the pH range 7 to 10. Thus, PAA would not be a preferred peracid bleach for use in the inventive system. The same would be true of peracid molecules with properties similar to monoperoxyphthalate and monopersulphate, which are very hydrophilic in nature and deliver poor tannin removal at low pH.

Typical organic peroxy acids which are useful include alkyl peroxy acids and aryl peroxy acids such as:

(i) peroxybenzoic acid and ring-substituted peroxybenzoic acids, e.g., peroxy-alpha-naphthoic acid.

(ii) aliphatic and substituted aliphatic monoperoxy acids, e.g., peroxylauric acid, peroxystearic acid, epsilon-phthalimido peroxyhexanoic acid and o-carboxybenzamido peroxyhexanoic acid, N-nonenylamidoperadipic acid and N-nonenylamidopersuccinic acid.

Diproxy acids may also be used as the organic peroxy acid and include alkyl peroxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxy-isophthalic acid (vi) 2-decyldiperoxybutane-1,4-dioic acid (vii) N,N'-terephthaloyl-di(6-aminopercaproic acid).

Preferred organic peroxy acids include epsilon-phthalimidoperoxyhexanoic acid (PAP), o-carboxybenzamidoperoxyhexanoic acid, and mixtures thereof.

The organic peroxy acid is present in the composition in an amount such that the level of organic peroxy acid in the wash solution is 1 ppm to 100 ppm Av Ox, preferably 3 ppm to 50 ppm Av Ox, most preferably 5 ppm to 30 ppm Av Ox.

The organic peroxy acid may be incorporated directly into the formulation or may be encapsulated by any number of encapsulation techniques.

A preferred encapsulation method is described in U.S. Pat. No. 5,200,236 issued to Langet al., herein incorporated by reference. In the patented method, the bleaching agent is encapsulated as a core in a paraffin wax material having a melting point from about 40° C. to about 50° C. The wax coating has a thickness of from 100 to 1500 microns.

Alpha (α) Amylase Enzymes

An effective amount of an amylase enzyme which, when incubated at 55° C. in a solution of 2 mM sodium citrate, 1 mM epsilon phthalimidoperoxyhexanoic acid in 36 ppm water at pH 8.0, has a half-life of two minutes or greater based on an activity vs. time plot obtained via monitoring color development at 405 nm of solution samples incubated with p-nitrophenyl-α-D-maltoheptaoside as substrate and gluco amylase and α-glucosidose as coupled enzymes. A preferred monitor is the Roche Cobas Fara Analyzer using Roche Reagent. Preferably, the half-life of the enzyme is 5 minutes or greater, preferably 10 minutes or greater.

Such α-amylase enzymes with improved oxidation stability and bleach resistance useful in the invention are described in WO 94/02597 (Novo); WO 94/14951 (Novo) and EP 208 491 (Genencor International Inc.) herein incorporated by reference.

The α-amylase enzymes should be present in the detergent composition in an amount providing an enzyme activity level in the wash solution of from about 50 mu/l to about $5\times10^4$ mu/l, preferably from about 100 mu/l is about $2\times10^4$ mu/l, more preferably from about 100 mu/l to about $10^4$ mu/l.

Amylolytic activity of the described α-amylases can be determined by a conventional method such as the one described in P. Bernfeld, Method of Enzymology, Vol. I (1995), pg. 149, herein incorporated by reference.

The α-amylase is a mutated amylase wherein one or more methionine amino acid residues is exchanged with an amino acid residue except for cysteine or methionine.

A preferred embodiment of the α-amylase is characterized by the fact that the alpha amylase is a Baciflus α-amylase. Preferred embodiments of the bleach resistant α-amylase are characterized by the fact that the α-amylase is *Bacillus licheniformis* α-amylase, *B. amyloliquefaciens* α-amylase and *B. stearothermophilus* α-amylase, and furthermore *Aspergillus niger* α-amylase. It has been found that this entire group of mutant α-amylases exhibit a half-life of greater than two minutes under the test conditions outlined in the "Summary of the Invention".

A preferred embodiment of the mutant α-amylase is characterized by the fact that one or more of the methionine amino acid residues is (are) exchanged with a Leu, Thr, Ala, Gly, Ser, lie, or Asp amino acid residue, preferably a Leu, Thr, Ala, or Gly amino acid residue. In this embodiment a very satisfactory activity level and stability in the presence of the oxidizing agents is obtained.

A preferred embodiment of the mutant α-amylase is characterized by the fact that the methionine amino acid residue in position 197 in *B. licheniformis* α-amylase or the methionine amino acid residue in homologous positions in other α-amylases is exchanged. The concept of homologous positions or sequence homology of α-amylase has been explained e.g. in Nakajima, R. et al., 1986, Appl. Microbiol. Biotechnol. 23, 355–360 and Liisa Holm et al., 1990, Protein Engineering 3, 181–191. Sequence homology of Bacillus α-amylases from *B. licheniforms, B. stearothermophilus* and *B. amyloliquefaciens* are about 60%. This makes it possible to align the sequences in order to compare residues at homologous positions in the sequence. By such alignment of α-amylase sequences the number in each α-amylase sequence of the homologous residues can be found. The homologous positions will probably spatially be in the same positions in a three dimensional structure (Greer, J., 1981, J. Mol. Biol. 153, 1027–1042) thus having analogous impact on specific functions of the enzyme in question. In relation to position 197 in *B. licheniformis* α-amylase, the homologous positions in *B. stearothermophils* α-amylase are positions 200 and 206, and the homologous position in *B. amyloliquefaciens* α-amylase is position 197. Experimentally it has been found that these mutuants exhibit both an improved activity level and an improved stability in the presence of oxidizing agents.

A preferred embodiment of the mutuant α-amylase according to the invention is characterized by the fact that one or both of the methionine amino acid residues in positions 200 and 206 in *B. stearothermophilus* α-amylase or the methionine amino acid residues in homologous positions in other α-amylases are exchanged. In relation to positions 200 and 206 in *B. stearothermophilus* α-amylase the homologous position in *B. licheniformis* α-amylase is 197 and the homologous position in *B. amyloliquefaciens* α-amylase is position 197. Experimentally it has been found that these mutants exhibit both an improved activity level and an improved stability in the presence of the oxidizing agents.

As illustrated in Example 2, 3 and 4 below, the preferred α-amylase was observed to exhibit a poor level of cleaning performance in a wash liquor having a pH of 10 or greater both in the presence and in the absence of an organic peroxy acid bleach (e.g., PAP). Thus, the improved bleach stability of the above described α-amylases gave little benefit in cleaning performance when the amylases are formulated in machine dishwashing compositions at pH levels greater than or equal to 10.

In order to obtain improved levels of starch removal with a detergent formulation containing α-amylases which are bleach resistant, it was observed that the pH of the wash liquor must be below 10, preferably 6 to 9.5, most preferably 7 to 9.5. (See Examples 5 and 6). As noted above, at a reduced alkalinity of less than pH 10, traditional peroxygen bleaching agents do not deliver a significant bleaching benefit.

Therefore, according to the invention the above described α-amylases must be formulated with an organic peroxy acid in a detergent composition, provided that a 1% aqueous solution of the detergent composition has a pH of less than 10, to provide overall effective performance on both starch and tannin.

Detergent Builder Materials

The compositions of this invention can contain all manner of detergent builders commonly taught for use in machine dishwashing or other cleaning compositions. The builders can include any of the conventional inorganic and organic water-soluble builder salts, or mixtures thereof and may comprise 1 to 75%, and preferably, from about 5 to about 70% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, pyrophosphates and hexametaphosphates.

Suitable examples of non-phosphorus-containing inorganic builders, when present, include water-soluble alkali metal carbonates, bicarbonates, sesquicarbonates, borates, silicates, metasilicates, and crystalline and amorphous aluminosilicates. Specific examples include sodium carbonate (with or without calcite seeds), potassium carbonate, sodium and potassium bicarbonates, silicates and zeolites.

Particularly preferred inorganic builders can be selected from the group consisting of sodium tripolyphosphate, potassium tripolyphosphate, potassium pyrophosphate, sodium carbonate, potassium carbonate, sodium bicarbonate, sodium silicate and mixtures thereof. When present in these compositions, sodium tripolyphosphate concentrations will range from about 2% to about 40%; preferably from about 5% to about 30%. Potassium tripolyphosphate concentrations will range from about 2% to about 50%, preferably from about 5% to about 40%. Sodium and potassium carbonate and bicarbonate when present can range from about 5% to about 50%; preferably from about 10% to about 30% by weight of the cleaning compositions. Sodium tripolyphosphate, potassium tripolyphosphate and potassium pyrophosphate can be used as builders in gel formulations, where they may be present from about 3 to about 50%, preferably from about 10 to about 40%.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062.

Alkali metal citrates, nitrilotriacetates, oxydisuccinates, polyphosphonates and acrylate/maleate copolymers and acrylate/maleate/vinyl alcohol terpolymers are especially preferred organic builders. When present they are preferably available from about 1% to about 35% of the total weight of the detergent compositions.

The foregoing detergent builders are meant to illustrate but not limit the types of builders that can be employed in the present invention.

Anti-Scalant

Scale formation on dishes and machine parts is an important problem that needs to be resolved or at least mitigated in formulating a machine warewashing product, especially in the case of low-phosphate (e.g. less than the equivalent of 20% by weight, particularly 10% by weight of sodium triphosphate) and phosphate-free machine warewashing compositions, particularly zero-P machine warewashing compositions.

In order to reduce this problem, co-builders, such as polyacrylic acids or polyacrylates (PAA), acrylate/maleate copolymers, and the various organic polyphosphonates, e.g. of the Dequest range, may be incorporated in one or more system components. For improved biodegradability, (as such co-builders), the block co-polymers of formula (I) as defined in published PCT patent specification WO 94/17170 may also be used. In any component, the amount of co-builder may be in the range of from 0.5 to 10, preferably from 0.5 to 5, and more preferably from 1 to 5% by weight.

Surfactants

Useful surfactants include anionic, nonionic, cationic, amphoteric, zwitterionic types and mixtures of these surface active agents. Such surfactants are well known in the detergent art and are described at length in "Surface Active Agents and Detergents", Vol. II, by Schwartz, Perry & Birch, Interscience Publishers, Inc. 1959, herein incorporated by reference.

Preferred surfactants are one or a mixture of:

Anionic surfactants

Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^1OSO_3M$$

where $R^1$ is a primary alkyl group of 8 to 18 carbon atoms and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. The solubilizing cation may be a range of cations which are in general monovalent and confer water solubility. Alkali metal, notably sodium, is especially envisaged. Other possibilities are ammonium and substituted ammonium ions, such as trialkanolammonium or trialkylammonium.

Alkyl Ether Sulfates $$R^1O(CH_2CH_2O)_nSO_3M$$

where $R^1$ is a primary alkyl group of 8 to 18 carbon atoms, n has an average value in the range from 1 to 6 and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. Preferably n has an average value of 2 to 5.

Fatty Acid Ester Sulfonates $$R^2CH(SO_3M)CO_2R^3$$

where $R^2$ is an alkyl group of 6 to 16 atoms, $R^3$ is an alkyl group of 1 to 4 carbon atoms and M is a solubilizing cation. The group $R^2$ may have a mixture of chain lengths. Preferably at least two thirds of these groups have 6 to 12 carbon atoms. This will be the case when the moiety $R^2CH(—)CO_2(—)$ is derived from a coconut source, for instance. It is preferred that $R^3$ is a straight chain alkyl, notably methyl or ethyl.

Alkyl Benzene Sulfonates $$R^4ArSO_3M$$

where $R^4$ is an alkyl group of 8 to 18 carbon atoms, Ar is a benzene ring ($C_6H_4$) and M is a solubilizing cation. The group $R^4$ may be a mixture of chain lengths. Straight chains of 11 to 14 carbon atoms are preferred.

Organic phosphate based anionic surfactants include organic phosphate esters such as complex mono- or diester phosphates of hydroxyl- terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^2CH(SO_3M)CO_2R^3$$

where the moiety $R^2CH(—)CO_2(—)$ is derived from a coconut source and $R^3$ is either methyl or ethyl.

Nonionic surfactants

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^5$ in the general formula:

$$R^5O(CH_2CH_2O)_nH$$

is from 6 to 20 carbon atoms. Notably the group $R^5$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^5$ which has 9 to 18 carbon atoms while n is from 2 to 8.

Also included within this category are nonionic surfactants having a formula:

$$R^6—(\underset{\displaystyle R^7}{\underset{|}{CH_2CHO}})_x(CH_2CH_2O)_y(\underset{\displaystyle R^8}{\underset{|}{CH_2CHO}})_zH$$

wherein $R^6$ is a linear alkyl hydrocarbon radical having an average of 6 to 18 carbon atoms, $R^7$ and $R^8$ are each linear alkyl hydrocarbons of about 1 to about 4 carbon atoms, x is an integer of from 1 to 6, y is an integer of from 4 to 20 and z is an integer from 4 to 25.

One; preferred nonionic surfactant of the above formula is Poly-Tergent SLF-18® a registered trademark of the Olin Corporation, New Haven, Conn. having a composition of the above formula where $R^6$ is a $C_6$–$C_{10}$ linear alkyl mixture, $R^7$ and $R^8$ are methyl, x averages 3, y averages 12 and z averages 16. Another preferred nonionic surfactant is $$R^9O(\underset{\displaystyle CH_3}{\underset{|}{CH_2CHO}})_j(CH_2CH_2O)_k(CH_2CH(OH)R^{10})_l$$

wherein $R^9$ is a linear, aliphatic hydrocarbon radical having from about 4 to about 18 carbon atoms including mixtures thereof; and $R^{10}$ is a linear, aliphatic hydrocarbon radical having from about 2 to about 26 carbon atoms including mixtures thereof; j is an integer having a value of from 1 to about 3; k is an integer having a value from 5 to about 30; and z is an integer having a value of from 1 to about 3. Most preferred are compositons in which j is 1, k is from about 10 to about 20 and l is 1. These surfactants are described in WO 94/22800. Other preferred nonionic surfactants are linear fatty alcohol alkoxylates with a capped terminal group, as described in U.S. Pat. No. 4,340,766 to BASF. Particularly preferred is Plurafac LF403 ex. BASF.

Another nonionic surfactant included within this category are compounds of formula:

$$R^{11}—(CH_2CH_2O)_qH$$

wherein $R^{11}$ is a $C_6$–$C_{24}$ linear or branched alkyl hydrocarbon radical and q is a number from 2 to 50; more preferably $R^{11}$ is a $C_8$–$C_{18}$ linear alkyl mixture and q is a number from 2 to 15.

polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbital tristearate, sorbitan monooleate, and sorbitan trioleate. The polyoxyethylene chains may contain between about 4 and 30 ethylene oxide units, preferably about 10 to 20. The sorbitan ester derivatives contain 1, 2 or 3 polyoxyethylene chains dependent upon whether they are mono-, di- or tri-acid esters. polyoxyethylene-polyoxypropylene block copolymers having formula:

$$HO(CH_2CH_2O)_a(CH(CH_3)CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

Amine oxides having formula:

$$R^{12}R^{13}R^{14}N{=}O$$

wherein $R^{12}$, $R^{13}$and $R^{14}$ are saturated aliphatic radicals or substituted saturated aliphatic radicals. Preferable amine oxides are those wherein $R^{12}$ is an alkyl chain of about 10 to about 20 carbon atoms and $R^{13}$ and $R^{14}$ are methyl or ethyl groups or both $R^{12}$ and $R^{13}$ are alkyl chains of about 6 to about 14 carbon atoms and $R^{14}$ is a methyl or ethyl group.

Amphoteric synthetic detergents can be broadly described as derivatives of aliphatic and tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituent contains from about 8 to about 18 carbon atoms and one contains an anionic water-solubilizing group, e.g., carboxy, sulpho, sulphato, phosphato or phosphoric. These compounds are frequently referred to as betaines. Besides alkyl betaines, alkyl amino and alkyl amido betaines are encompassed within this invention.

Alkyl Glycosides $$R_{15}O(R_{16}O)_n(Z^1)_p$$

wherein $R^{15}$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{16}$ is a divalent hydrocarbon radical containing from 2 to about 4 carbon atoms such as ethylene, propylene or butylene (most preferably the unit $(R^{16}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG® 300, 325 and 350 with $R^{15}$ being $C_9$–$C_{11}$, n is and p is 1.3, 1.6 and 1.8–2.2 respectively; APG® 500 and 550 with $R^{15}$ is $C_{12}$–$C_{13}$, n is O and p is 1.3 and 1.8–2.2, respectively; and APG® 600 with $R^{15}$ being ($C_{12}$–$C_{14}$, n is O and p is 1.3.

While esters of glucose are contemplated especially, it is envisaged that corresponding materials based on other reducing sugars, such as galactose and mannose are also suitable.

Particularly preferred anionic surfactants are the fatty acid ester sulfonates with formula:

$$R^2CH(SO_3M)CO_2R^3$$

where the moiety $R^2CH(—)CO_2(—)$ is derived from a coconut source methyl or ethyl.

The amount of glycoside surfactant, anionic surfactant and/or ethoxylated fatty alcohol surfactant will be from 0.5 to 40% by weight of the composition. Desirably the total amount of surfactant lies in the same range. The preferred range of surfactant is from 0.5 to 30% by weight, more preferably from 0.5 to 15% by weight.

An inert particulate filler material which is water-soluble may also be present in cleaning compositions. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 60%, preferably from about 5% to about 30% by weight of the cleaning composition.

Thickeners and Stabilizers

Thickeners are often desirable for liquid cleaning compositions. Thixotropic thickeners such as smectite clays including montmorillonite (bentonite), hectorite, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for machine dishwashing compositions is disclosed for example in U.S. Pat. Nos. 4,431,559; 4,511,487; 4,740,327; 4,752,409. Commercially available synthetic smectite clays include Laponite supplied by Laporte Industries. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a. more intense white appearance to the composition than other clays. The amount of clay thickener employed in the compositions is from 0.1 to about 10%, preferably 0.5 to 5%. Use of salts of polymeric carboxylic acids is disclosed for example in UK Patent Application GB 2,164,350A, U.S. Pat. No. 4,859,358 and U.S. Pat. No. 4,836,948.

For liquid formulations with a "gel" appearance and rheology, particularly if a clear gel is desired, a chlorine-resistant polymeric thickener is particularly useful. U.S. Pat. No. 4,260,528 discloses natural gums and resins for use in clear machine dishwashing detergents, which are not chlorine stable. Acrylic acid polymers that are cross-linked manufactured by, for example, B.F. Goodrich and sold under the trade name "Carbopol" have been found to be effective for production of clear gels, and Carbopol 940, 617 and 627, having a molecular weight of about 4,000,000 are particularly preferred for maintaining high viscosity with excellent chlorine stability over extended periods. Further suitable chlorine-resistant polymeric thickeners are described in U.S. Pat. No. 4,867,896 incorporated by reference herein.

The amount of thickener employed in the compositions is from 0 to 5%, preferably 0.5–3%.

Stabilizers and/or co-structurants such as long-chain calcium and sodium soaps and $C_2$ to $C_{18}$ sulfates are detailed in U.S. Pat. Nos. 3,956,158 and 4,271,030 and the use of other metal salts of long-chain soaps is detailed in U.S. Pat. No. 4,752,409. Other co-structurants include Laponite and metal oxides and their salts as described in U.S. Pat. No. 4,933,101, herein incorporated by reference. The amount of stabilizer which may be used in the liquid cleaning compositions is from about 0.01 to about 5% by weight of the composition, preferably 0.01–2%. Such stabilizer are optional in gel formulations. Co-structurants which are found especially suitable for gels include trivalent metal ions at 0.01–4% of the compositions, Laponite and/or water-soluble structuring chelants at 0.01–5%. These co-structurants are more fully described in the co-pending U.S. Pat. No. 5,141,664 by Corring et al., filed Dec. 30, 1987, which application is hereby incorporated by reference.

Anti-Tarnishing Agents

Anti-tarnishing agents may be incorporated into the compositions. Such agents include benzotriazole, certain 1,3 N-azoles described in allowed U.S. Ser. No. 08/301,459 to Gary et al.; isocyanuric acid described in U.S. Pat. No. 5,374,369 by Angevaare et al.; and purine compounds described in Ser. No.08/302,284.

Defoamer

The formulations of the cleaning composition comprising surfactant may further include a defoamer. Suitable defoamers include mono-and distearyl acid phosphate, silicone oil and mineral oil. Even if the cleaning composition has only defoaming surfactant, the defoamer assists to minimize foam which food soils can generate. The compositions may include 0.02 to 2% by weight of defoamer, or preferably 0.05–1.0%. Preferred antifoam systems are described in Angevaare et al. 95–158-EDG, herein incorporated by reference.

Optional Ingredients

Minor amounts of various other components may be present in the cleaning composition. These include bleach scavengers including but not limited to sodium bisulfite, sodium perborate, reducing sugars, and short chain alcohols; solvents and hydrotropes such as ethanol, isopropanol and xylene sulfonates; flow control agents (in granular forms); enzyme stabilizing agents; soil suspending agents; antiredeposition agents; anti-corrosion agents; ingredients to enhance decor care such as certain aluminum salts described in U.S. Ser. Nos. 08/444,502 and 08/444,503, herein incorporated by reference; colorants; perfumes; and other functional additives.

The following examples will serve to distinguish this invention from the prior art and illustrate its embodiments more fully. Unless otherwise indicated, all parts, percentages and proportions referred to are by weights.

EXAMPLE 1

The half-lives of amylases were determined by the method in the specification. Thus, the amylase, at a level of $4\times10^3$ mu/l, was incubated at 55° C. in a solution containing 2 mM sodium citrate, 1 mM sodium citrate, 1 mM epsilon phthalimidoperoxyhexanoic acid and 36 ppm hardness ions with a calcium to magnesium ratio of 4:1 and maintained at pH 8.0. Samples were withdrawn at suitable intervals and analyzed for enzyme activity on a Roche Cobas Fara Analyzer using Roche Reagent. This contains p-nitrophenyl-α-D-maltoheptaoside as the substrate which is hydrolyzed by the amylase in question to give p-nitrophenylmaltotriose. This moiety is then hydrolyzed by glycoamylase to p-nitrophenylmaltotriose, which in turn is hydrolyzed by gluco amylase to p-nitrophenyl glycoside and further hydrolyzed by α-glucosideose to p-nitrophenol. The absorbance of p-nitrophenol is measured at 405 nm.

The results for Termanyl, Duramyl and Purafect® OxAm 4000 G (ex. Genencor) are given in Table 1.

TABLE 1

| t ½ in minutes | | |
|---|---|---|
| Termamyl | Duramyl | Purafect ® OxAm 4000G |
| <1 | 13 | >20 |

Thus, Termamyl) is outside the scope of the invention.

EXAMPLE 2

The amylolytic activity and starch removal performance of a bleach resistant α-amylase (Duramyl, supplied by Novo) was compared to that of a conventional amylase (i.e. Termamyl, supplied by Novo) under model wash conditions in a beaker at pH 10, 55° C.

Two detergent compositions were prepared, including an amount of Duramyl and Termamyl to provide an enzymatic activity level of 220 Maltose units per liter in the wash solution. Also included in the compositions were 0.2 g/l sodium nitrilotriacetate and carbonate/bicarbonate buffer containing 1.7 g/l of $Na_2CO_3.1OH_2O$ and 0.34 g/l of $NaHCO_3$. No bleaching agent was added to either sample. The pH of an aqueous solution of each of the compositons was adjusted to pH 10 with NaOH or $H_2SO_4$ as needed.

The amylolytic activity of the two types of enzyme was determined as follows:

Model wash solutions containing carbonate/bicarbonate buffer, builder (if present) and hardness ions (if present) are stirred in a constant temperature jacketed beaker. Enzyme and bleach (if present) are added. Samples are withdrawn from this solution at fixed times and added to solid starch azure, a crystalline potato starch polymer linked with Remazol Brilliant Blue. This mixture is incubated for a set time, centrifuged and the color development in the supernatant measured. This experiment measures the change in enzyme activity over time.

Absorbance values were recorded over a 60 minute time period. The greater the absorbance value, the higher the activity of the enzyme in the composition. The following results were obtained at pH 10.

TABLE 2

| | Absorbance at 596 nm (or Amylase Activity) | |
|---|---|---|
| Elapsed time (min) | Duramyl | Termamyl |
| 0 | 0.44 | 1.23 |
| 10 | 0.53 | 1.17 |
| 20 | 0.27 | 1.24 |
| 30 | 0.29 | 1.23 |
| 40 | 0.25 | 1.23 |
| 50 | 0.23 | 1.30 |
| 60 | 0.22 | 1.26 |

At pH 10, with no bleach present, the conventional amylase exhibited a significantly higher enzymatic activity than the composition containing the α-amylase of the present invention.

The starch removal performance of the two samples was also compared in an industrial dishwasher by washing three racks of dishes, each rack being loaded with a range of dishware that included ten starch-soiled plates. The components of the cleaning composition were dosed into the machine just once, prior to washing the first rack of dishes. Since there was no further dosing of product, each successive wash resulted in a 10% dilution of the product concentration due to the introduction of fresh rinse water at the end of each main wash. There was a waiting period of 5 minutes between the processing of the second and third racks of dishes. The level of residual starch was assessed visually after disclosure of the washed plate in iodine solution.

Termamyl 300 L and Duramyl 300 L were each dosed to give $4\times10^3$ Mu/l in the wash. The following results were obtained.

TABLE 3

| | Residual Starch (% Area) | | |
|---|---|---|---|
| Sample | Rack 1 | Rack 2 | Rack 3 |
| Termamyl 300L | 13 | 13 | 12 |
| Duramyl 300L | 100 | 100 | 100 |

Consistent with the observed amylolytic activity profiles above, at a wash pH of 10 and in the absence of bleach, the composition containing the conventional amylase, Termamyl 300L, was observed to give significantly better starch removal performance than the novel α-amylase when both were incorporated in a detergent composition as described above.

EXAMPLE 3

The compositions of Example 2 were modified by incorporating hydrogen peroxide (100 ppm Av Ox) or hypochlorite (60 ppm Av. Cl) as bleaching agent. Three racks of soiled dishware were washed as described in Example 2 and evaluated for residual starch soil with the following results.

TABLE 4

| | | Residual Starch (% Area) | | |
|---|---|---|---|---|
| Bleach | Enzyme | Rack 1 | Rack 2 | Rack 3 |
| Hypochlorite | Termamyl 300L | 100 | 100 | 100 |
| | Duramyl 300L | 100 | 100 | 100 |
| Hydrogen Peroxide | Termamyl 300L | 7 | 8 | 10 |
| | Duramyl 300L | 100 | 100 | 100 |

Chlorine bleach has a devastating impact on the stability of both amylase variants and so the cleaning results are poor in both cases. There is a big improvement in enzyme stability when the bleach is hydrogen peroxide. However, the starch removal performance of both enzymes remained essentially unchanged relative to the composition with no bleach described in Example 2. Thus, in the presence of hydrogen peroxide at pH 10, it is the conventional amylase, not the bleach-resistant amylase that gives the better starch removal performance.

EXAMPLE 4

Epsilon-phthalimido peroxyhexanoic acid (PAP) and peracetic acid (PAA) were both used in lieu of the hydrogen peroxide as peroxygen bleaching agent in the sample of Example 2 containing the Duramyl α-amylase. The pH of the wash solution was adjusted to a value of 10. The starch removal performance of the composition containing Duramyl and these peracids was also observed after three washing cycles as described in Example 2. Residual starch levels were 70, 100 and 95% respectively, when the bleaching agent was PAP, and were 15, 100 and 100% respectively when the bleaching agent was PAA.

Therefore, substituting the conventional oxygen bleaching agent, hydrogen peroxide, with a more powerful peracid bleaching agent (PAP or PAA) did not significantly improve the starch removal performance of the Duramyl α-amylase when formulated in a detergent composition at pH 10, and therefore at this wash pH there is still no benefit for this novel α-amylase over the conventional Termamyl amylase.

EXAMPLE 5

The amylolytic activity of both a bleach-resistant amylase and Termamyl were monitored at a wash pH of 8.5, both in the absence and presence of PAP. The technique used is the same as that described in Example 2. The relative amylase activities, based on absorbancies, are given in Table 6.

TABLE 6

| | Relative Amylase Activity at pH 8.5 | | | |
|---|---|---|---|---|
| Elapsed Time (minutes) | Duramyl | Duramyl + PAP | Termamyl | Termamyl + PAP |
| 0 | 1.25 | 2.5 | 0.75 | 0.75 |
| 5 | 1.0 | 2.4 | 1.0 | 0.5 |
| 10 | 1.0 | 2.25 | 1.0 | 0.8 |
| 15 | 0.85 | 1.7 | 1.0 | 0.2 |
| 20 | 0.90 | 1.25 | 1.0 | 0.2 |
| 30 | 1.0 | 1.0 | 1.0 | 0.2 |

Unexpectedly, the amylolytic activity of the formulation containing the α-amylase according to the invention was synergistically enhanced by addition of the peracid at pH 8.5. In contrast, the activity of Termamyl decreased on addition of the PAP. This enhancement between the bleach-resistant amylase and PAP did not occur at pH 10, as seen from the absorbance data in Table 6.

TABLE 7

RELATIVE AMYLASE ACTIVITY AT pH 10.0

| Elapsed time (minutes) | Duramyl | Duramyl + PAP |
|---|---|---|
| 0 | 0.14 | 0.06 |
| 5 | 0.11 | 0.05 |
| 10 | 0.12 | 0.10 |
| 15 | 0.08 | 0.18 |
| 20 | 0.06 | 0.04 |
| 30 | 0.06 | 0.05 |

Again, this is surprising since one would have expected that as the pH moved down from pH 10 to pH 8.5, that is as the pH moved to the range of greatest activity for PAP, the effect on Duramyl would be negative, not positive. Also, this positive synergistic benefit on the bleach-resistant amylase activity occurs at the pH region where the functionality of PAP (i.e. bleaching of tannin) is optimum.

EXAMPLE 6

The starch and tannin removal performance profiles were determined for a bleach-resistant α-amylase in combination with a wide range of peracid bleaching agents (i.e. hydrophobic monoperoxy- and diperoxy-acids; hydrophilic monoperoxy acid; inorganic peroxyacid).

The cleaning experiments were conducted in a domestic dishwashing machine wherein the wash temperature was maintained at 55° C. and the wash pH at 8.5 (with borate buffer) or 10 (with carbonate/bicarbonate buffer). In one type of experiment where only four times stained tea cups were included, the wash time was 30 seconds. In a second test, where a combination of soiled tea cups and starch soiled plates were included, the wash time was 2 minutes.

The results of these tests are given in Table 8.

TABLE 8

| | Wash | 30 second wash | 2 minute wash | |
|---|---|---|---|---|
| PERACID | pH | Residual Tea+ | Residual Tea+ | Residual Starch |
| PAP | 8.5 | 0 | 0 | 45 |
| TPCAP* | 8.5 | 0.7 | 0.8 | 39 |
| DPDDA** | 8.5 | 1.0 | 0.3 | 37 |
| H48*** | 8.5 | 2.4 | 1.5 | 26 |
| H48 | 10 | 1.5 | — | — |
| KMPS**** | 8.5 | 2.9 | 2.0 | 34 |
| KMPS | 10 | 2.0 | — | — |

*N,N[1]-terephthaloyl-di (6-amino percaproic acid)
**1,12-diperoxydodecanedioic acid
***magnesium monoperoxyphthalate
****potassium monopersulfate
+The stained tea cups are rated on a zero (no residual stain) to five (heavy stain) scale. The difference between zero and non-zero tea scores is considered to be highly significant because any residual tea stain rapidly builds up during subsequent re-use and re-washing steps.

With regard to starch removal, the foregoing was designed to be a highly stressed performance test in order to clearly demonstrate differences. Differences in the starch removal scores for KMPS, DPDDA, TPCAP, PAP and H48 systems at pH 8.5 are considered to be small and all systems are capable of giving good levels of starch removal. However, there were significant differences in tannin removal. H48 and KMPS gave very poor levels of tannin removal at pH 8.5 and PAP was significantly better than both DPDDA and TPCAP.

Thus, the system that gives overall the best tannin and starch cleaning profile is the PAP/amylase system with the other hydrophobic peracid/enzyme combinations some distance behind.

EXAMPLE 7

Surprisingly, it is found that the stability of Duramyl towards bleach is greatly enhanced when builder is present in the wash solution. A similar enhanced stability was not observed with Termamyl. The amyloyltic activity was monitored by the following method:

Starch azure, a crystalline potato starch polymer linked with Remazol Brilliant Blue, is heated in distilled water at 80° C. for 15 minutes and transferred to glass slides (1 inch×1 inch) which are then dried at room temperature overnight. The slides are weighed. Model wash solutions containing pH 8.5 borate buffer, builder (at 0.56 g/l if present) and hardness ions (36 ppm expressed as $CaCO_3$;4:1 Ca:Mg ratio) are stirred and maintained at 55° C. in a constant temperature jacketed beaker. Three retrograded starch slides are added to the beaker, followed by either Duramyl or Termamyl and then PAP (at 1 mM). The absorbance of aliquots are measured at 596 nm to give an assessment of in-wash enzyme activity. In addition, at the end of the experiment, the slides are dried and weighed to determine the level of soil removal.

The builders evaluated were sodium nitrilotriacetate, sodium citrate and an acrylate/maleate/vinyl alcohol terpolymer from Huls, described in U.S. Pat. No. 4,686,062. The activity of the enzymes was followed over a period of 30 minutes. The results are shown in Table 9.

TABLE 9

| Ingredients* | A | B | C | D | E | F | G | H |
|---|---|---|---|---|---|---|---|---|
| NTA | X | ✓ | X | X | X | ✓ | X | X |
| Citrate | X | X | ✓ | X | X | X | ✓ | X |
| Huls Polymer | X | X | X | ✓ | X | X | X | ✓ |
| Duramyl | ✓ | ✓ | ✓ | ✓ | X | X | X | X |
| Termamyl | X | X | X | X | ✓ | ✓ | ✓ | ✓ |
| PAP | ✓ | ✓ | ✓ | ✓ | ✓ | ✓ | ✓ | ✓ |
| Time (minutes) | Residual Amylolytic Activity (%) | | | | | | | |
| 0 | 100 | 100 | 100 | 100 | 100 | 100 | 100 | 100 |
| 5 | 10 | 75 | 75 | 75 | 0 | 5 | 5 | 5 |
| 10 | 5 | 75 | 65 | 70 | 0 | 0 | 0 | 0 |
| 15 | 5 | 65 | 65 | 75 | 0 | 0 | 0 | 0 |
| 20 | 5 | 65 | 65 | 65 | 0 | 0 | 0 | 0 |
| 25 | 0 | 65 | 60 | 65 | 0 | 0 | 0 | 0 |
| 30 | 0 | 65 | 55 | 55 | 0 | 0 | 0 | 0 |

✓ means present in the wash.
*X means absent from the wash solution.

Good stability of the bleach-resistant amylase in the presence of bleach is only obtained when builder is present in the wash solution (see B, C and D compared to A). A similar enhancement of the stability of Termamyl, traditional amylase, is not observed (see F, G, H compared to E).

EXAMPLE 8

Using the same procedure outlined in Example 7, the effect of water hardness on the stability of a bleach-resistant amylase in the presence of 2 mM NTA and 20 ppm Av Ox PAP was evaluated at 65° C. The activity of Duramyl was followed over 30 minutes. The results are shown in Table 10.

TABLE 10

| Residual Amylolytic Activity | | | | |
|---|---|---|---|---|
| | Water Hardness (expressed as $CaCO_3$; 4:1 Ca:Mg ratio) | | | |
| Time (min.) | 0 ppm | 10 ppm | 36 ppm | 80 ppm |
| 0 | 100 | 100 | 100 | 100 |
| 5 | 40 | 50 | 80 | 80 |
| 10 | 20 | 40 | 75 | 75 |
| 15 | 15 | 30 | 70 | 70 |
| 20 | 10 | 25 | 65 | 70 |
| 25 | 10 | 25 | 60 | 65 |
| 30 | 5 | 20 | 60 | 60 |

This demonstrates that hardness ions have a beneficial effect on the amylolytic stability of the bleach-resistant enzyme in the presence of builder and PAP.

We claim:

1. A warewashing composition for a mechanical dishwashing machine comprising:

(a) an organic monoperoxy or diperoxy acid which exhibits maximum tannin stain removal efficacy at a wash pH of about 8.5 which is at or near the pKa of the peroxy acid the organic peroxy acid being present in an amount of 1 ppm to 100 ppm available $O_2$ in the solution;

(b) an amylase enzyme which, when incubated at 55° C. in a solution of 2 mM sodium citrate, 1 mM epsilon phthalimidoperoxyhexanoic acid in 36 ppm water at pH 8.0, has a half-life of 10 minutes or greater based on an activity vs. time plot obtained via monitoring color development at 405 nm of solution samples incubated with p-nitrophenyl-α-D-maltoheptaoside as substrate and gluco amylase and α-glucosidase as coupled enzymes; and (c) 1% by weight to 75% by weight of a builder, provided that a 1% aqueous solution of the warewashing composition has a pH of 6 to 9.5.

2. A composition according to claim 1 wherein the organic mono peroxy acid is selected from a group consisting of a peroxy benzoic acid, an aryl substituted peroxy benzoic acid, an aliphatic monoperoxy acid, a substituted aliphatic monoperoxy acid and mixtures thereof.

3. A composition according to claim 2 wherein the aliphatic monoperoxy acid is selected from the group of epsilon-phthalimidoperoxyhexanoic acid (PAP), o-carboxybenzamidoperoxyhexanic acid, N-nonenylamidoperadipic acid, N-noneylaminopersuccinic acid and mixtures thereof.

4. A composition according to claim 1 wherein the diperoxy acid is selected from the group consisting of 1,12-diperoxydodecanedioic acid; 1,9-diperoxyazelaic acid; diperoxybrassylic acid; diperoxysebacic acid; diperoxyisophthalic acid; 2-decyldiperoxybutane-1,4-dioic acid and N,N'-terephthaloyl-di (6-aminopercaproic acid).

5. A composition according to claim 1 wherein the organic peroxy acid is encapsulated in a paraffin wax coating having a melting point from about 40° C. to about 50° C.

6. A composition according to claim 1 wherein the α-amylase enzyme is Bacillus α-amylase.

7. A composition according to claim 1 wherein the α-amylase enzyme has one or more of its methionine amino acid residues exchanged for any amino acid residue except for cysteine and methionine.

8. A composition according to claim 1 wherein the builder is selected from the group consisting of inorganic water soluble builder salts, organic water builder salts and mixtures thereof.

9. A composition according to claim 8 wherein the organic water soluble builder salt is selected from the group consisting of alkali metal citrates, succinates, malonates., fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates, polyacetal carboxylates and polyaspartates, and mixtures thereof.

10. A composition according to claim 9 wherein the builder is present in the amount of 1 to 40% by weight.

11. A composition according to claim 10 further comprising an enzyme selected from the group consisting of a protease and a lipase in an effective amount to remove soils.

12. A composition according to claim 11 further comprising an anti-tarnishing agent selected from the group consisting of a purine, a 1,3-N azole, a cyanuric acid and mixtures thereof in an effective amount to prevent tarnishing.

13. A composition according to claim 12 wherein the anti-tarnish agent is benzotriazole.

14. A composition according to claim 1 wherein the pH of the aqueous solution is about 6 to about 9.

15. A composition according to claim 1 wherein wash water into which the composition is dosed has a water hardness of greater than 10 ppm expressed as calcium carbonate.

16. A method of cleaning dishware in a machine dishwashing machine comprising:

(a) applying an effective amount of a detergent composition comprising:

(i) an amylase enzyme which, when incubated at 55° C. in a solution of 2 mM sodium citrate, 1 mM epsilon phthalimidoperoxyhexanoic acid in 36 ppm water at pH 8.0, has a half-life of 10 minutes or greater based on an activity vs. time plot obtained via monitoring color development at 405 nm of solution samples incubated with p-nitrophenyl α-D-maltoheptaoside as substrate and gluco amylase and α-glucosidase as coupled enzymes;

(ii) an organic monoperoxy or diperoxy acid which exhibits maximum tannin stain removal efficacy at a wash pH of about 8.5,which is at or near the pKa of the peroxy acid, the organic peroxy acid being present in an amount of 1 ppm to 100 ppm available $O_2$ in the solution; and (iii) 1% by weight to 75% by weight of a builder, provided that a 1% aqueous solution of the warewashing composition has a pH of 6 to 9.5, and (b) rising the detergent composition from the cleaned dishware to substantially provided clean dishes.

17. A method according to claim 16 wherein the organic mono peroxy acid is selected from a group consisting of a peroxy benzoic acid, an aryl substituted peroxy benzoic acid, an aliphatic monoperoxy acid, a substituted aliphatic monoperoxy acid and mixtures thereof.

18. A method according to claim 17 wherein the aliphatic monoperoxy acid is selected from the group of epsilon-phthalimidoperoxyhexanoic acid (PAP), o-carboxybenzamidoperoxyhexanoic acid, acid N-nonenylamidoperadipic acid, N-nonenylaminopersuccinic acid and mixtures thereof.

19. A method according to claim 16 wherein the diperoxy acid is selected from the group consisting of 1,12-diperoxydodecanedioic acid; 1,9-diperoxyazelaic acid; diperoxybrassylic acid; diperoxysbacic acid; diperoxyisophthalic acid; 2-decyldiperoxybutane- 1,4-dioic acid and N,N'-terephthaloyl -di(6-aminopercaproic acid).

20. A method according to claim 16 wherein the organic peroxy acid is encapsulated in a paraffin wax coating having a melting point from about 40° C. to about 50° C.

21. A method according to claim 16 wherein the α-amylase enzyme is Bacillus α-amylase.

22. A method according to claim 16 wherein the α-amylase enzyme has one or more of its methionine amino acid residues exchanged for any amino acid residue except for cysteine and methionine.

23. A method according to claim 16 wherein the builder is selected from the group consisting of inorganic water soluble builder salts, organic water builder salts and mixtures thereof.

24. A method according to claim 23 wherein the organic water soluble builder salt is selected from the group consisting of alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates, polyacetal carboxylates and polyaspartates, and mixtures thereof.

25. A method according to claim 16 wherein the builder is present in the amount of 1 to 40% by weight.

26. A method according to claim 16 further comprising an enzyme selected from the group consisting of a protease and a lipase in an effective amount to remove soils.

27. A method according to claim 16 further comprising an anti-tarnishing agent selected from the group consisting of a purine, a 1,3-N azole, a cyanuric acid and mixtures thereof in an effective amount to prevent tarnishing.

28. A method according to claim 27 wherein the anti-tarnish agent is benzotriazole.

29. A method according to claim 16 wherein the detergent composition is dosed into a wash water having a hardness of greater than 10 ppm expressed as calcium carbonate.

* * * * *